US006682405B2

(12) United States Patent
Shimokawa

(10) Patent No.: US 6,682,405 B2
(45) Date of Patent: Jan. 27, 2004

(54) POLISHING APPARATUS HAVING A DRESSER AND DRESSER ADJUSTING METHOD

(75) Inventor: Kimiaki Shimokawa, Tokyo (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 0 days.

(21) Appl. No.: 09/906,799

(22) Filed: Jul. 18, 2001

(65) Prior Publication Data

US 2002/0132562 A1 Sep. 19, 2002

(30) Foreign Application Priority Data

Mar. 15, 2001 (JP) ..... 2001/073550

(51) Int. Cl.[7] ..... B24B 1/00

(52) U.S. Cl. ..... 451/56; 451/72; 451/443; 451/444

(58) Field of Search ..... 451/56, 72, 443, 451/444

(56) References Cited

U.S. PATENT DOCUMENTS

| | | | | | |
|---|---|---|---|---|---|
| 5,287,663 | A | * | 2/1994 | Pierce et al. | 451/539 |
| 5,605,499 | A | | 2/1997 | Sugiyama et al. | 451/443 |
| 5,626,509 | A | * | 5/1997 | Hayashi | 451/285 |
| 6,077,155 | A | * | 6/2000 | Hayakawa et al. | 451/288 |
| 6,159,075 | A | | 12/2000 | Zhang | 451/8 |
| 6,169,931 | B1 | | 1/2001 | Runnels | 700/97 |
| 6,220,936 | B1 | * | 4/2001 | Quek | 451/41 |
| 6,302,772 | B1 | * | 10/2001 | Hosoki et al. | 451/56 |
| 6,338,669 | B1 | * | 1/2002 | Togawa et al. | 451/36 |
| 6,354,918 | B1 | * | 3/2002 | Togawa et al. | 451/56 |
| 6,428,399 | B1 | * | 8/2002 | Tanabe et al. | 451/66 |
| 6,443,815 | B1 | * | 9/2002 | Williams | 451/56 |

* cited by examiner

*Primary Examiner*—Joseph J. Hail, III
*Assistant Examiner*—Alvin J Grant
(74) *Attorney, Agent, or Firm*—Volentine Francos, PLLC

(57) ABSTRACT

The polishing particle surface of the dresser of a chemical mechanical polishing apparatus used for a planarization process in manufacturing semiconductor devices is inclined. Moreover, the pressure to be applied onto the polishing surface of the dresser is linearly varied with a nonzero slope.

20 Claims, 9 Drawing Sheets

POLISHING APPARATUS HAVING A DRESSER AND DRESSER ADJUSTING METHOD

BACKGROUND OF THE INVENTION

1. Field of the Invention

The present invention relates to a chemical mechanical polishing apparatus that is used for manufacturing semiconductor devices. In particular, the present invention relates to a polishing adjustment of a polishing pad using a dresser.

2. Description of Related Art

FIGS. 9A–9D show drawings for explaining the prior art. A state in which a polishing pad 102 is dressed is shown. As shown in FIG. 9A, a dresser 103 is placed on a polishing pad 102 that is adhered onto a surface plate 101. When a pressure is applied to the dresser 103, the surface of the polishing pad 102 is ground by a diamond particle surface 103A formed on the peripheral surface zone of the dresser 103. As a result, the surface of the polishing pad 102 is polished as shown in FIG. 9A. In general, an abrasive material or pure water is supplied to the polishing pad during a dressing process.

Polishing is carried out in a planarization process during manufacturing of a semiconductor device or the like. During such polishing, however, the abrasive material and/or polishing dust sticks to the surface of the polishing pad 102, which eventually causes the polishing process to become unstable. For this reason, in order to maintain stable polishing, the polishing pad 102 needs to be dressed and polished by the dresser 103.

However, the above-described prior art has the following problem. As shown in FIGS. 9B and 9C, the grind amount of the portion of the polishing pad 102 at distance Rt from the center of rotation of the surface plate 101 is proportional to the contact length L of the diamond particle surface 103A, with the polishing pad 102 at distance Rt from the center of the surface plate 101. By a simple calculation, the length L is given by $$L=2\cdot Rt\cdot(\mathrm{Cos}^{-1}((Rt^2+Rx^2-R1^2)/(2\cdot Rt\cdot Rx))-\mathrm{Cos}^{-1}((Rt^2+Rx^2-R2^2)/(2\cdot Rt\cdot Rx)) \quad (1)$$

Here, as shown in FIGS. 9B and 9C,

Rx: the distance between the center of the dresser 103 and the center of the surface plate 101;

R1: the outside radius of the diamond particle surface 103A; and

R2: the inside radius of the diamond particle surface 103A.

FIG. 11 shows the dependency of the contact length L of the diamond particle surface 103A with the surface of the polishing pad 102 at distance Rt from the center of the surface plate 101 when, for example, Rx=17 cm, R1=16 cm, and R2=15.5 cm. The graph shows that the length L varies over a wide range within the polishing pad. Since the grind amount of the polishing pad 102 is proportional to the length L, the grind amount of the polishing pad 102 varies over a wide range. As a result, the surface of the polishing pad 102 cannot be made flat as needed. The minimum grind amount required to achieve a satisfactory state of polishing is pre-determined. Therefore, even at a location where the value of L is the smallest, the required minimum grind amount must be secured. On the other hand, at a location where the value of L is large, the polishing pad is overground.

As discussed above, the value of L grows very large in a region near the periphery of the surface plate (at points 29 cm from the center of the surface plate) and in a region near the center of the surface plate (at points 1.5 cm from the center of the surface plate). Therefore, in these regions, the polishing pad is ground by a large amount. The problem that the polishing pad is ground by a large amount in a region near the periphery of the surface plate can be solved by increasing the diameter of the dresser 103. FIG. 12 shows the dependency of L on the distance Rt from the center of the surface plate 101 in case the diameter of the dresser 103 has been increased to Rx=20 cm, R1=19 cm, and R2=18.5 cm. In this case, as seen from FIG. 12, the value of L is 1.47 cm at the point where Rt=29 cm, which is shorter by 2.1 cm than the value of L at the point where Rt=29 cm in the case shown in FIG. 11. However, in the interior of the admissible range, the value of L achieves a maximum of 2.44 cm at the point where Rt=1.5 cm, which is not significantly smaller than the maximum value of L achieved at Rt=1.5 cm in the case shown in FIG. 11, resulting in practically no improvement at all.

Thus, in the case the grind amount of the polishing pad varies over a wide range depending on the distance Rt from the center of the surface plate 101, the life span of the polishing pad is seriously shortened. A polishing pad is dressed and ground after it has been used to polish a prescribed number of semiconductor wafers. FIG. 10 is a schematic cross sectional view of the grind surface 102A of the polishing pad 102 attached onto the polishing surface plate 101. In FIG. 10, the region 102A1 where the grind amount is the largest (position 1.5 cm from the center of the surface plate), the region 102A2 where the grind amount is the smallest (position 6.9 cm from the center of the surface plate), and the region 102A3 which is the outer limit of the admissible polishing range (position 29.0 cm from the center of the surface plate) are indicated with arrows.

As mentioned before, in order to carry out stable polishing, the polishing pad must be ground at least by a minimum necessary amount. The region 102A2, where the grind amount is the smallest (position 1.5 cm from the center of the surface plate), must also be ground at least by the same minimum necessary amount, which is 0.67 $\mu$m per wafer in this case. However, in the region 102A1, where the grind amount is the largest (position 1.5 cm from the center of the surface plate), 1.67 $\mu$m per wafer is ground. The life span of the polishing pad 102 is determined by the amount ground by the dressing. Therefore, if the polishing pad 102 is dressed by an excessive amount, even the surface of the polishing surface plate 101 can be ground. When this happens, the surface of the polishing surface plate 101 is damaged, and the polishing surface plate 101 needs to be replaced.

As explained above, the polishing pad 102 is ground by a large amount in the interior of the admissible polishing range even though other parts of the polishing pad 102 remain sufficiently thick within the admissible polishing range. Therefore, the polishing pad 102, which is relatively expensive among the required items for manufacturing semiconductors, needs to be replaced at an early stage. This means that the semiconductor manufacturing cost is significantly increased. Moreover, it normally takes 1 to 1.5 hours to replace a polishing pad, during which time the CMP apparatus cannot manufacture any semiconductor devices, resulting in a low operation rate. As the life span of the polishing pad 102 becomes shorter, the polishing pad 102 must be replaced more frequently, which leads to a low operation rate of the apparatus.

SUMMARY OF THE INVENTION

The present invention aims to solve the above-described problems. Therefore, it is an object of the present invention to provide a polishing apparatus having a dresser equipped with a polishing pad and an inclined polishing particle surface for adjusting polishing. It is also an object of the present invention to provide a polishing apparatus having a dresser equipped with a polishing pad and a polishing particle surface for adjusting polishing such that a pressure for adjusting a polishing can be applied onto the polishing particle surface. This object is achieved by combinations as will be described. Further advantageous and exemplary combinations of the present invention are also described.

This summary of the invention does not necessarily describe all necessary features of the present invention. The present invention may also be a sub-combination of the above-described features. The above and other features and advantages of the present invention will become more apparent from the following description of embodiments taken in conjunction with the accompanying drawings.

DETAILED DESCRIPTION OF THE INVENTION

The present invention will now be described based on preferred embodiments, which do not intend to limit the scope of the present invention, but exemplify the invention. Not all of the features and the combinations thereof described in the embodiment are necessarily essential to the invention.

Figure 1A:
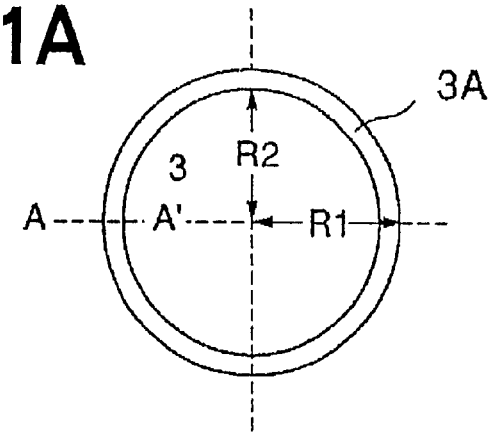
FIGS. 1A–1C show a top view and a cross sectional view of a dresser ring according to a first embodiment of the present invention.
Figure 1B:
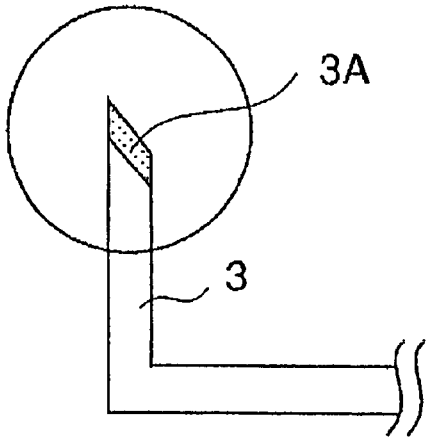
Figure 1C:
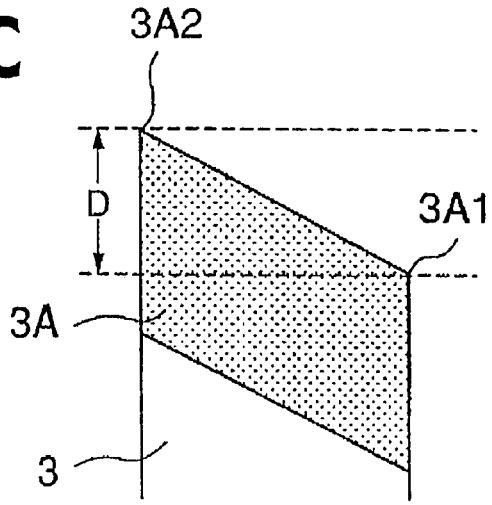

FIGS. 1A–1C show a first embodiment of the present invention. FIG. 1A shows a cross sectional view of a dresser ring 3. The dresser ring 3 shown in FIG. 1A is installed on a polishing surface plate 101 as in the prior art, and a dressing process is carried out. FIG. 1B shows the cross section across the line A–A' of the dresser ring 3 shown in FIG. 1A. FIG. 1C shows a magnified view of what is shown in FIG. 1B. In the first embodiment of the invention, as shown in FIG. 1B and FIG. 1C, the surface of the diamond particle surface 3A of the dresser ring 3 is inclined with respect to the surface of the polishing pad 102. Because of this inclination, when the dresser ring 3 is pressed onto the polishing pad 102 at a constant pressure, the displacement amount of the polishing pad 102 varies across the points between 3A1 and 3A2. As a result, the press-down pressure varies across the points between 3A1 and 3A2.

Figure 2:
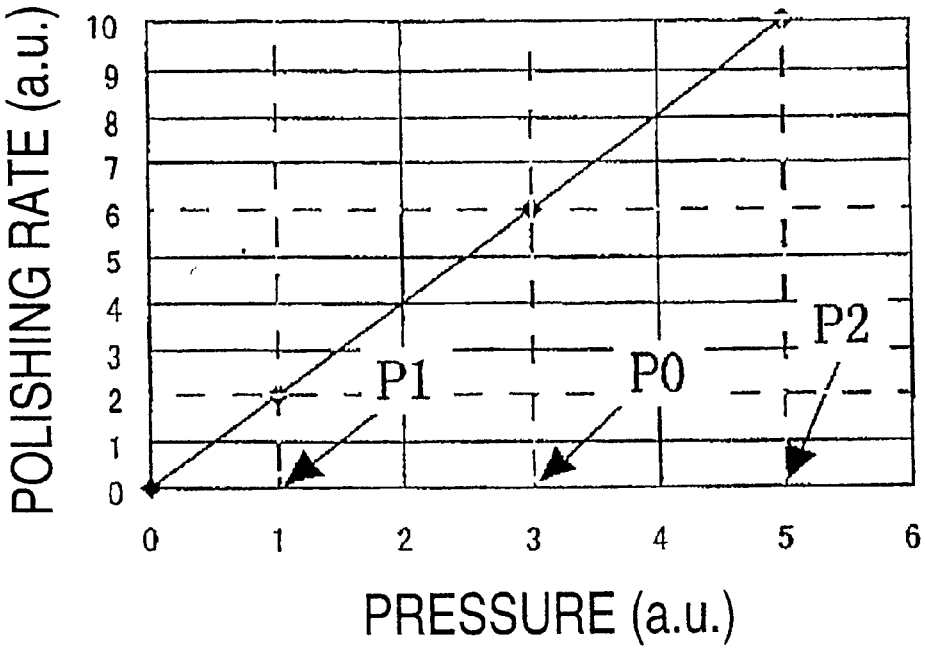
FIG. 2 shows the relation between the press-down pressure of the dresser ring and the grind rate of the polishing pad according to the first embodiment of the present invention.

As a consequence, each point on the polishing pad 102 is ground by the dressing action at a different rate. In other words, the controlled grind rate is distributed in the radial direction of the diameter of the dresser ring 103. In the present embodiment, the above-described inclination was prescribed by determining the value of D shown in FIG. 1C so that the grind rate of the polishing pad 102 at outside diameter point 3A2 in the radial direction will be 5 times as large as the grind rate of the polishing pad 102 at inside diameter point 3A1. More specifically, using a dresser ring 103 identical to the one used in the prior art shown in FIG. 9, the relation between the press-down pressure of the dresser ring 103 applied onto the polishing pad 102 and the grind rate with respect to the press-down pressure is obtained. If the relation between the pressure and the obtained grind rate turns out to be, for example, the one shown in FIG. 2, the desired grind rate ratio of 5 to 1 is obtained. As a result, the pressures P1 and P2 can be obtained.

Figure 3:
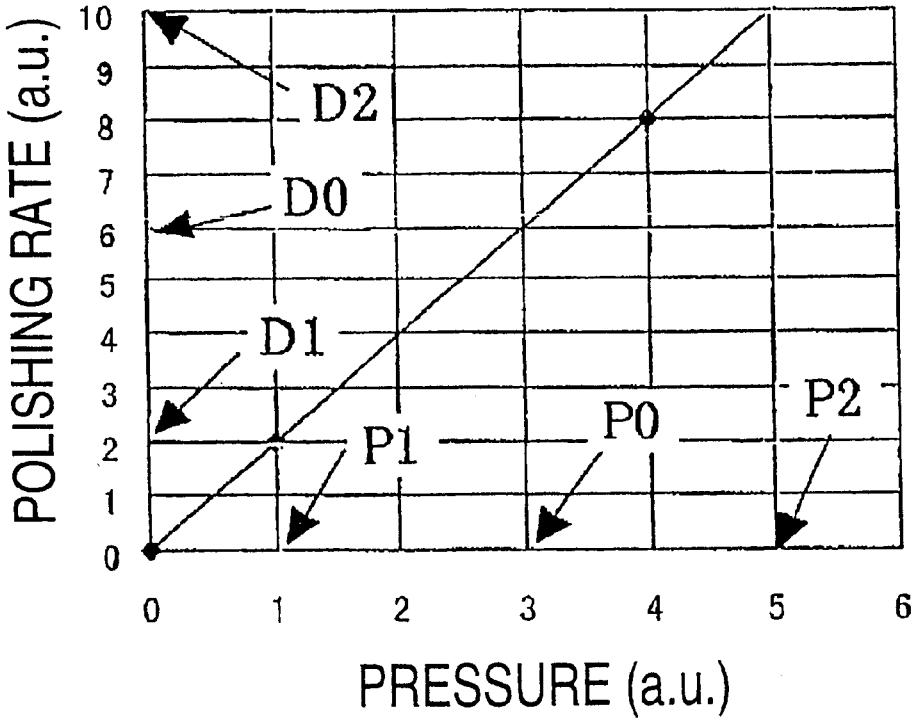
FIG. 3 shows the relation between the pressure of the polishing pad and the amount of displacement of the polishing pad according to the first embodiment of the present invention.
Figure 4:
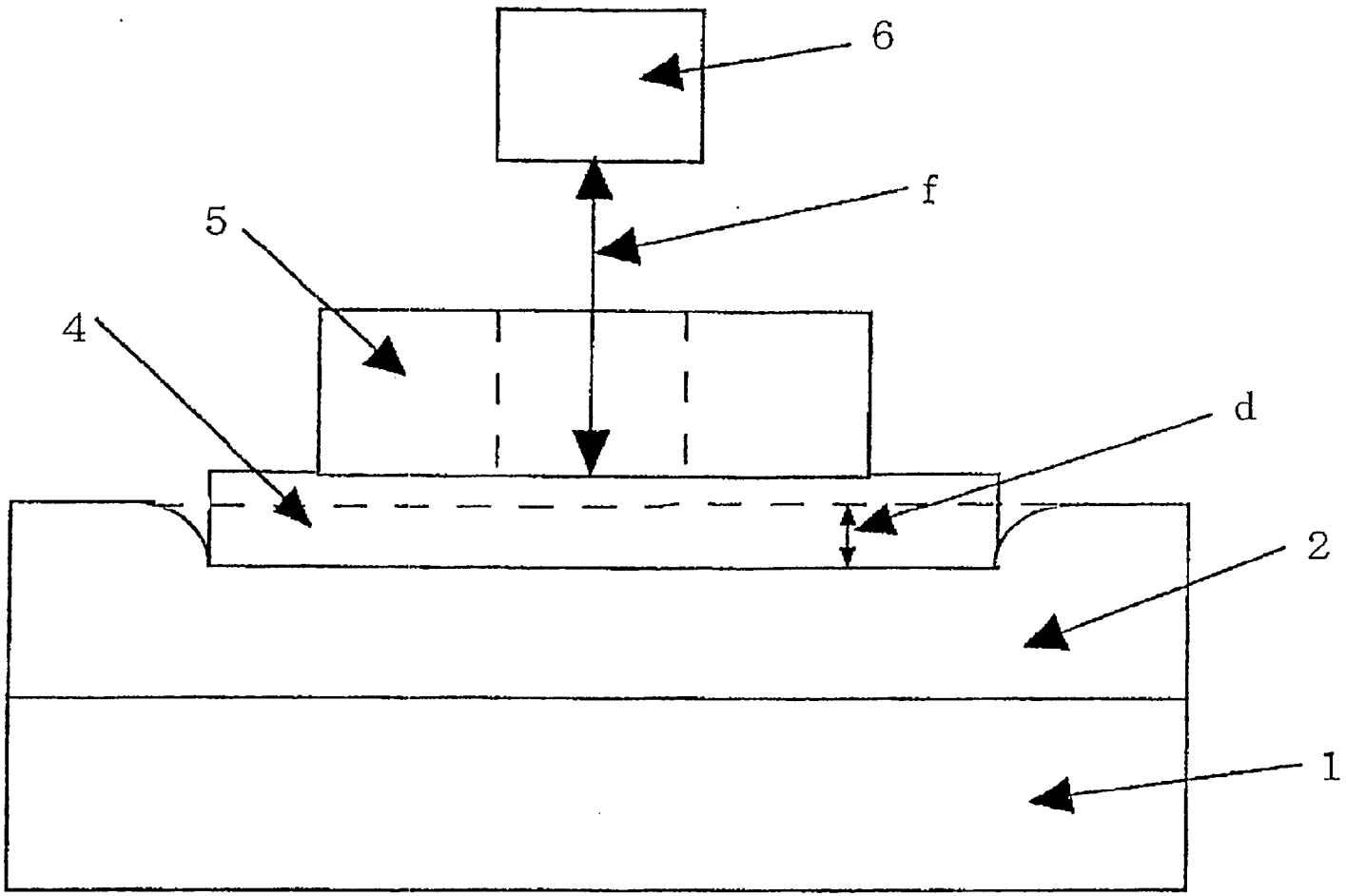
FIG. 4 shows a cross sectional view of a polishing apparatus for measuring the displacement amount of the polishing pad according to the first embodiment of the present invention.

Next, the relation between the press-down pressure applied onto the polishing pad 102 and the displacement amount of the polishing pad 102 is obtained. If the relation between the press-down pressure applied onto the polishing pad 102 and the displacement amount of the polishing pad 102 is, for example, as the one shown in FIG. 3, the displacement amounts D1 and D2 of the polishing pad 102 caused by the pressures P1 and P2, respectively, are obtained. In this case, the value of the aforementioned quantity D is determined by the equation D=D1−D2. Here, the relation between the press-down pressure applied onto the polishing pad 102 and the displacement amount of the polishing pad 102 is obtained as follows. In FIG. 4, which shows a cross sectional view of a polishing apparatus for measuring the displacement amount of a polishing pad, a first load 4 and a second load 5 are placed on a polishing pad 2. The displacement amount d of the polishing pad 2 in this case is obtained by measuring the displacement of the position f of the surface of the first load 4. The position f is easily measured by a laser displacement gauge 6. Similarly, by changing the weight of the second load 5, the relation between the pressure and the polishing pad displacement amount d is obtained a shown in FIG. 3.

The dresser ring 3, which has been formed using the value of D obtained in the above-described manner, is pressed onto the polishing pad 2 with the press-down pressure P0=(P1+P2)/2, and a dressing process is carried out. As a result, the dresser ring 3 is pressed onto the polishing pad 2 with the pressures of P1 and P2 at positions 3A1 and 3A2 of FIG. 1C, respectively. In this case, the polishing pad grind rate at 3A2 becomes 5 times as large as that at 3A1. The grind rate obtained in the prior art depends solely on the contact length L of the polishing pad with the dresser. In contrast, according to the present embodiment, the press-down pressures at distinct contact points differ from each other. Therefore, the grind rate of the polishing pad 2 in the dressing process according to the present embodiment depends not only on the contact length L of the polishing pad with the dresser, but also on the press-down pressure at each contact point.

Figure 5:
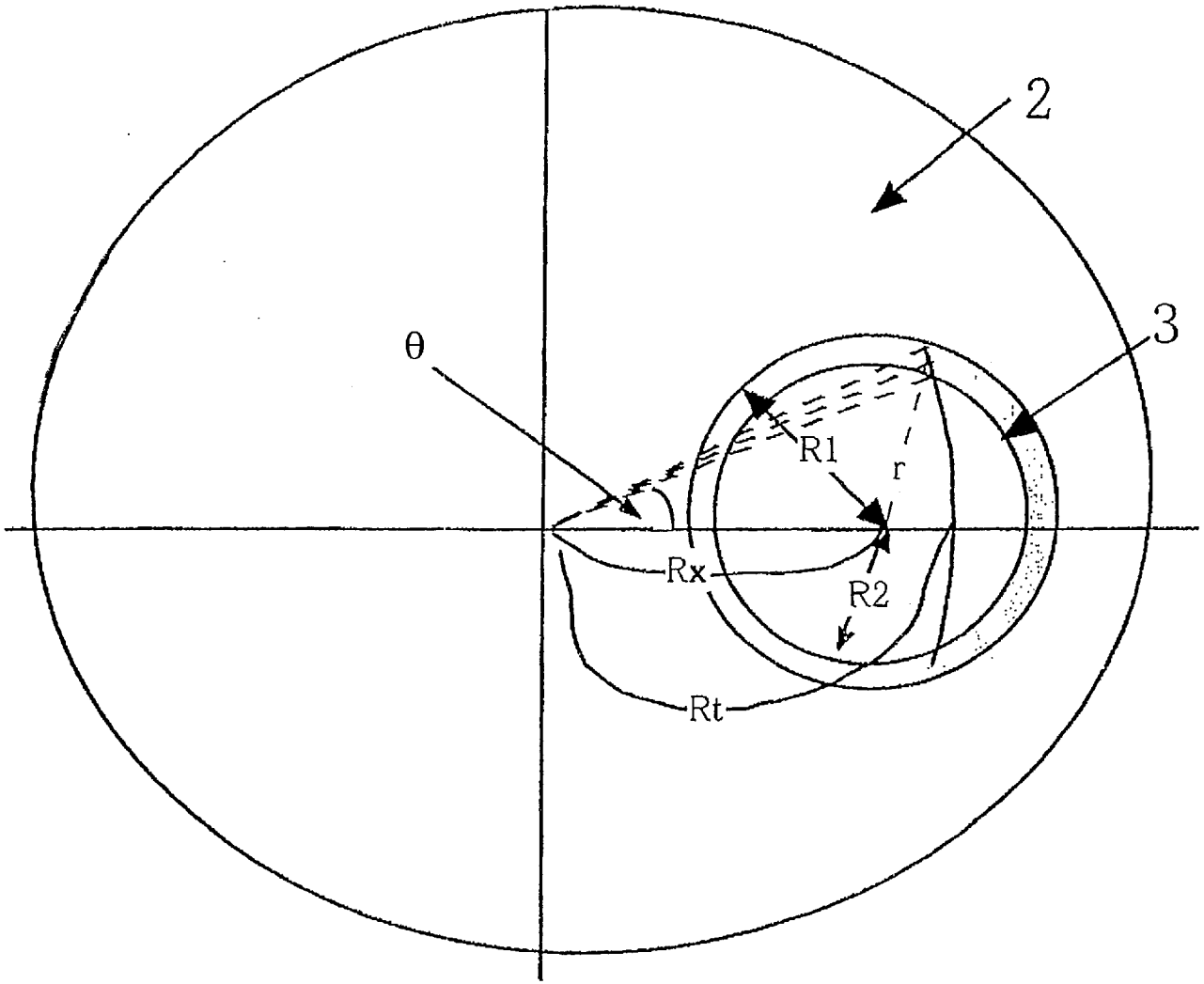
FIG. 5 shows a top view of the polishing pad according to the first embodiment of the present invention.

More specifically, in FIG. 5 which shows a top view of the polishing pad 2, the polishing pad grind rate at points that are at distance Rt from the center of the polishing surface plate 1 is obtained by integrating the function $$K(r)\cdot Rt \tag{2}$$

from θ2 (the value of angle θ at which the circle of radius Rt centered at the center of the polishing surface plate 1 intersects the inner boundary circle of radius R2 of the dresser ring 3) to θ1 (the value of angle θ at which the circle of radius Rt centered at the center of the polishing surface plate 1 intersects the outer boundary circle of radius R1 of the dresser ring 3). Here, by a geometric analysis of the drawing on FIG. 5, K(r) is given by $$K(r)=k\cdot((r-R2)\cdot 4/(R1-R2)+1),\ k=\text{constant}. \tag{3}$$

Since r is a function of angle θ, K(r) is expressed as a function of θ as follows.

$$K(r)=K(\theta)=k\cdot(((Rt-\cos\theta Rx)^2+Rt\cdot\sin^2\theta)^{0.5}-R2)\cdot 4/(P1-P2)+1 \tag{4}$$

The grind rate V(Rt) of the polishing pad at points that are at distance Rt from the center of the surface plate is given by $$\int_{\theta 2}^{\theta 1} k\cdot(((Rt\cdot\cos\theta-Rx)^2+Rt\cdot\sin^2\theta)^{0.5}-R2)\cdot 4/(R1-R2)+1)\cdot Rt\cdot d\theta. \tag{5}$$

Here,

- Rx: the distance between the center of the dresser 3 and the center of the polishing surface plate 1;
- R1: the radius of the outer boundary circle of the dresser ring 3; and
- R2: the radius of the inner boundary circle of the dresser ring 3.

Figure 6:
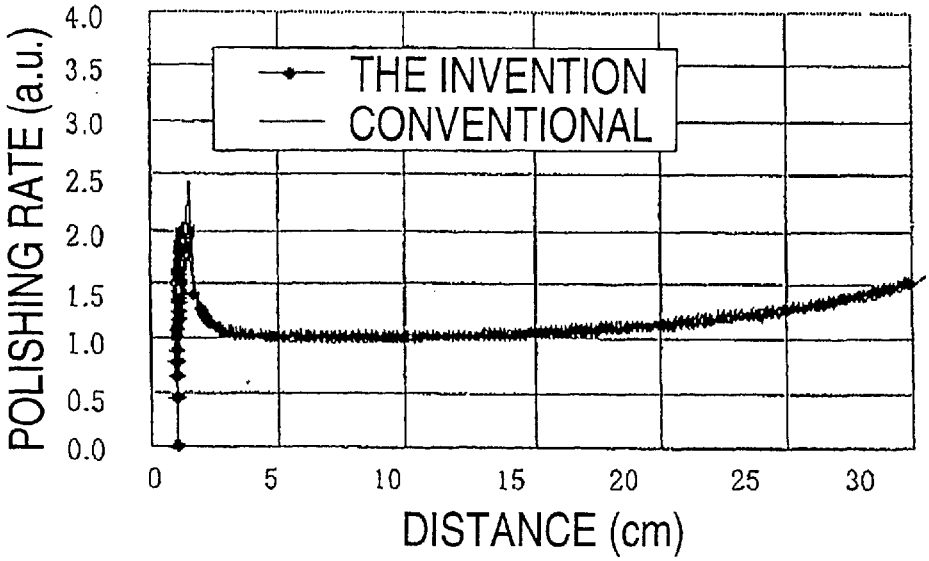
FIG. 6 shows a graph of the relation between the distance from the center of the surface plate and the grind rate of the polishing pad according to the first embodiment of the present invention.

FIG. 6 shows a graph which expresses the relation between the grind rate V(Rt) and the distance Rt from the center of the polishing surface plate 1 in the case Rx=20 cm, R1=19 cm, and R2=18.5 cm. In FIG. 6, for ease of comparison with the prior art, the constant k is prescribed so that the minimum grind rate according to this embodiment is achieved at the same point at which the minimum grind rate is achieved in the prior art. As shown in FIG. 6, the grind rate according to the prior art is 2.44 (relative value) at the point where the grind rate of the polishing pad 2 is maximum in the interior of the admissible polishing range. On the other hand, the grind rate according to the present embodiment is 2.03 (relative value). Thus, according to the present embodiment, the grind rate can be controlled. As a result, the polishing pad cost is reduced and the operation rate of the CMP apparatus is improved.

Figure 7:
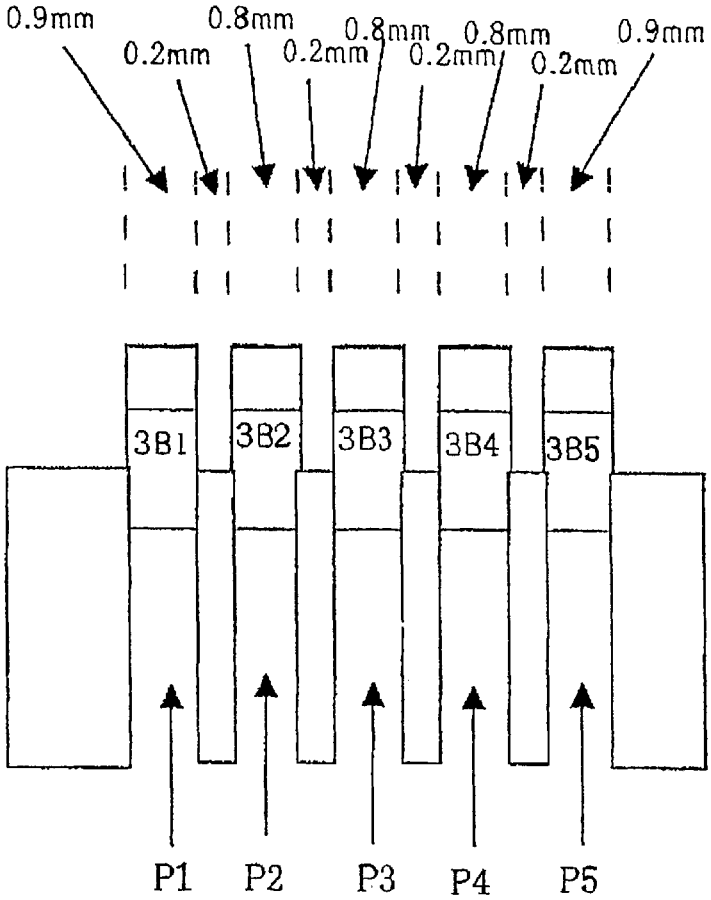
FIG. 7 shows a cross sectional view of a dresser ring according to a second embodiment of the present invention.

Next, a cross sectional view of a dresser ring according to a second embodiment of the present invention is shown in FIG. 7. As in the case of the first embodiment, FIG. 7 shows a cross sectional view of the dresser ring 3 across the line A–A'. As shown in FIG. 7, according to the second embodiment of the present invention, the diamond particle surface of the dresser ring and its support pad are divided into five parts 3B1, 3B2, 3B3, 3B4, and 3B5. Further, distinct pressures P1, P2, P3, P4, and P5 are applied to 3B1, 3B2, 3B3, 3B4, and 3B5, respectively. The values of these pressures are determined as follows. Using the graph shown in FIG. 2, the value of P2 is determined so that the grind rate at 3B2 will be 74% of the grind rate at 3B1. Similarly, the values of P3, P4, and P5 are determined so that the grind rates at 3B3, 3B4, and 3B5 will be 48%, 39%, and 30% respectively of the grind rate at 3B1. In this way, the dresser ring is divided into five parts and pressures of distinct values are applied to the five parts, so that the grind rates at these parts are sequentially inclined, or in other words grind rates of parts 3B1–3B5 have respectively decreased values with respect of each other. Therefore, the grind rate of the polishing pad V(Rt) (relative value) at points that are distance Rt from the center of the polishing surface plate is given by the following equation (6).

$$\begin{aligned}
V(Rt)=&k\cdot Rt\cdot(Cos^{-1}(Rt^2+Rx^2-R11^2)/(2\cdot Rt\cdot Rx))-Cos^{-1}(Rt^2+Rx^2-R21^2)/(2\cdot Rt\cdot Rx)))+0.74\cdot k\cdot Rt\cdot(Cos^{-1}(Rt^2+Rx^2-R12^2)/(2\cdot Rt\cdot Rx))-Cos^{-1}(Rt^2+Rx^2-R22^2)/(2\cdot Rt\cdot Rx)))+0.48\cdot k\cdot Rt\cdot(Cos^{-1}(Rt^2+Rx^2-R13^2)/(2\cdot Rt\cdot Rx))-Cos^{-1}(Rt^2+Rx^2-R23^2)/(2\cdot Rt\cdot Rx)))+0.39\cdot k\cdot Rt\cdot(Cos^{-1}(Rt^2+Rx^2-R14^2)/(2\cdot Rt\cdot Rx))-Cos^{-1}(Rt^2+Rx^2-R24^2)/(2\cdot Rt\cdot Rx)))\\
&+0.30\cdot k\cdot Rt\cdot(Cos^{-1}(Rt^2+Rx^2-R15^2)/(2\cdot Rt\cdot Rx))-Cos^{-1}(Rt^2+Rx^2-R25^2)/(2\cdot Rt\cdot Rx)))
\end{aligned} \tag{6}$$

Here the inner and outer diameters of the dresser ring are the same as in the prior art, and

- R11: the outer radius of 3B1=19.0 cm, R21: the inner radius of 3B1=18.91 cm;
- R12: the outer radius of 3B2=18.89 cm, R22: the inner radius of 3B2=18.81 cm;
- R13: the outer radius of 3B3=18.79 cm, R23: the inner radius of 3B3=18.71 cm;
- R14: the outer radius of 3B4=18.69 cm, R24: the inner radius of 3B4=18.61 cm; and
- R15: the outer radius of 3B5=18.59 cm, R25: the inner radius of 3B4=18.50 cm.

Figure 8:
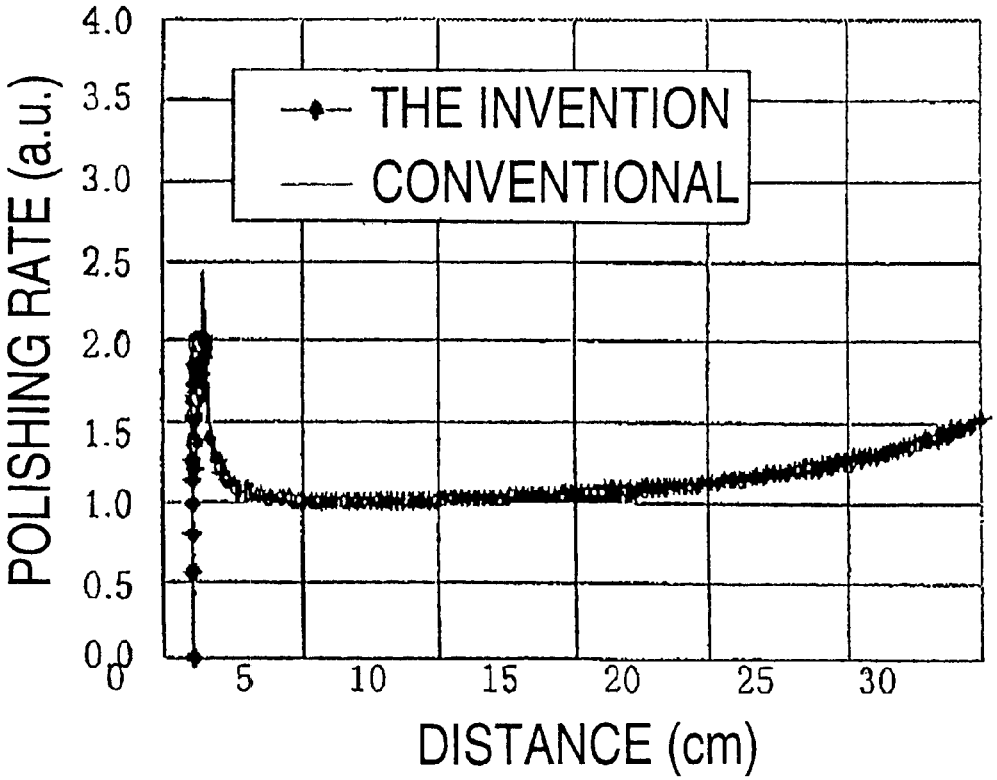
FIG. 8 shows a graph of the relation between the distance from the center of the polishing surface plate and the grind rate of the pad according to the second embodiment of the present invention.
Figure 9A:
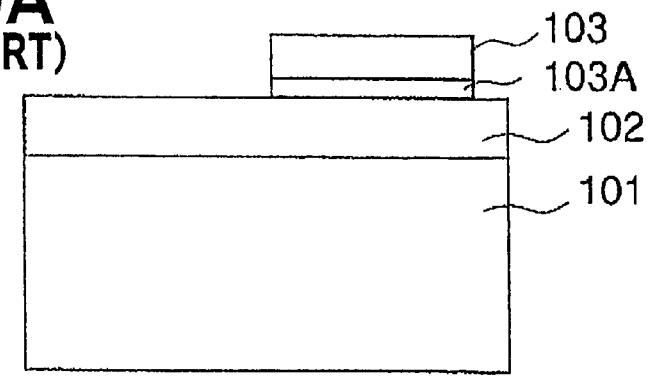
FIG. 9A (PRIOR ART)
FIGS. 9A–9D show a top view and a cross sectional view of a dresser ring according to the prior art.
Figure 9B:
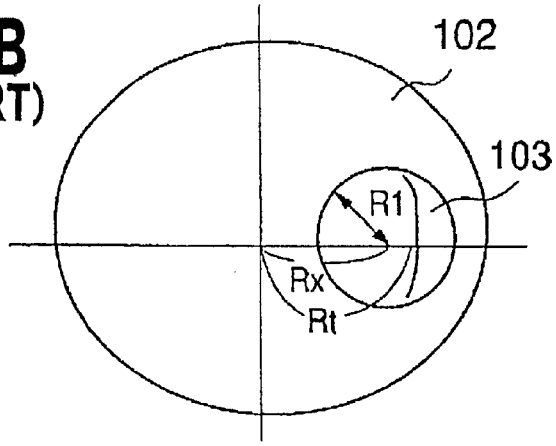
FIG. 9B (PRIOR ART)
Figure 9C:
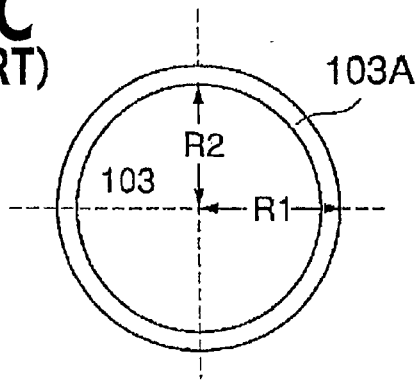
FIG. 9C (PRIOR ART)
Figure 9D:
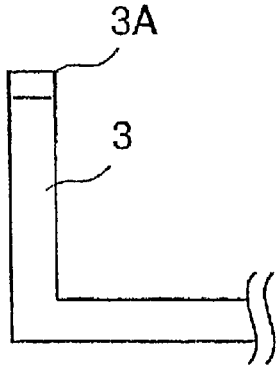
FIG. 9D (PRIOR ART)
Figure 10:
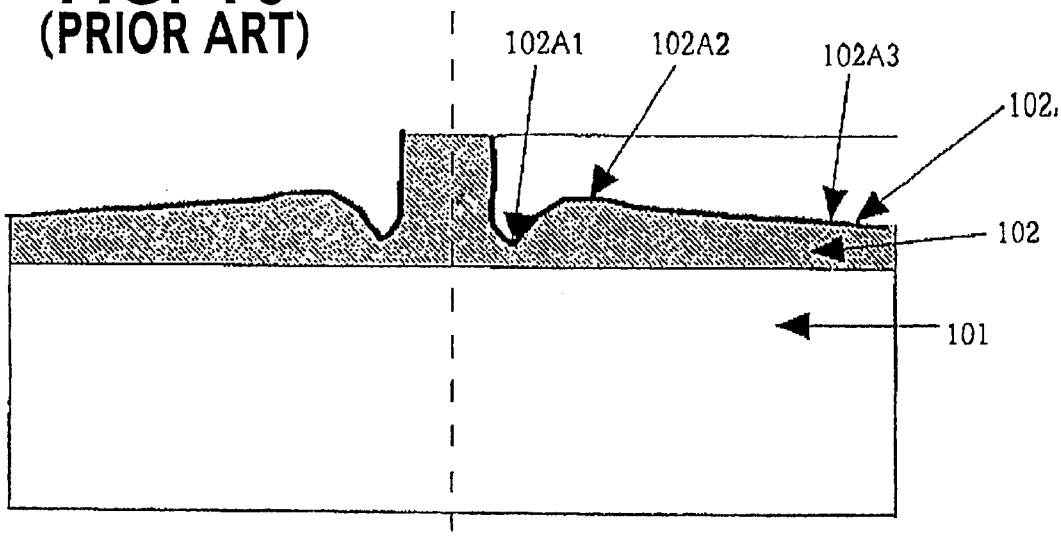
FIG. 10 (PRIOR ART)
FIG. 10 shows a cross sectional view of the polishing pad during polishing according to the prior art.
Figure 11:
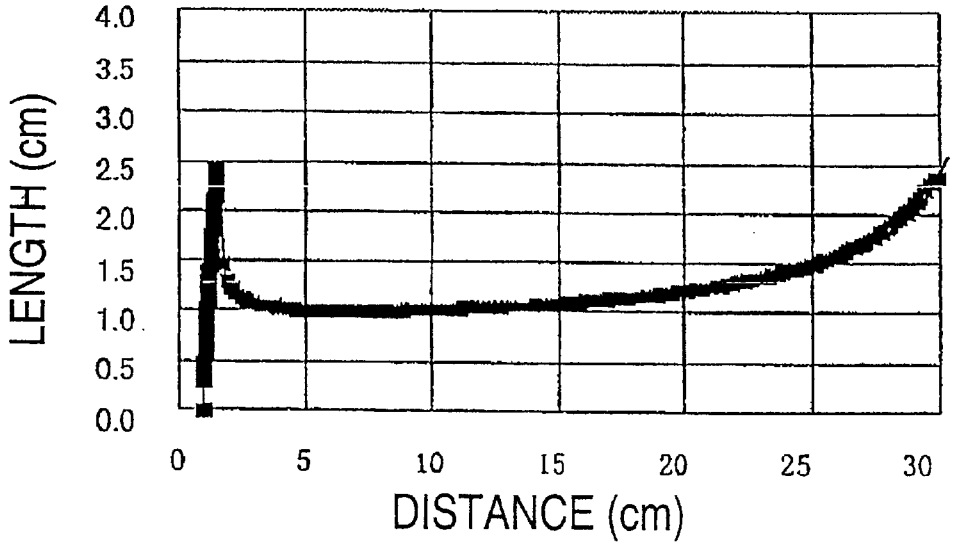
FIG. 11 (PRIOR ART)
FIG. 11 shows a graph of the relation between the distance from the center of the polishing surface plate and the contact length of the diamond particle surface with the polishing pad according to the prior art.
Figure 12:
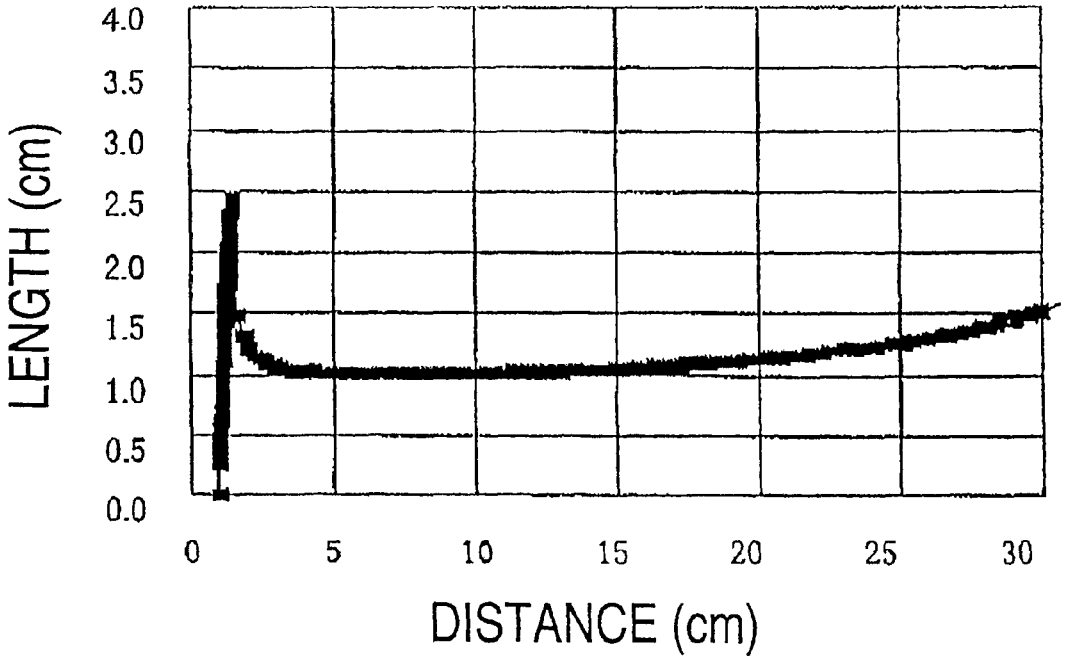
FIG. 12 (PRIOR ART)
FIG. 12 shows a graph of the relation between the distance from the center of the polishing surface plate and the contact length of the diamond particle surface with the polishing pad in the case the diameter of the dresser is large, according to the prior art.

Using these values, Equation (6) is evaluated. FIG. 8 shows the result of this calculation. For ease of comparison with the prior art, the minimum grind rate according to this embodiment is set equal to the minimum grind rate obtained in the prior art.

As seen from the graph shown in FIG. 8, which shows the relation between the distance from the center of the polishing surface plate 1 and the grind rate of the polishing pad, in the interior of the admissible polishing range, the maximum polishing rate is 2.03 according to the present embodiment. This value is substantially equal to the maximum polishing rate obtained in the first embodiment. This value is significantly better than the maximum polishing rate obtained in the prior art, which is 2.44 (relative value). Therefore, according to the second embodiment also, the same polishing pad cost reduction effect and the same degree of operation rate improvement of the CMP apparatus are achieved.

According to the present invention, the pressure applied onto the polishing pad 102 by the dresser 103 used in the prior art is varied linearly with a nonzero slope in the radial direction of the diameter of the dresser 103. Therefore, the maximum grind amount of the polishing pad within the admissible polishing range is reduced. As a result, the life span of the polishing pad 102 with respect to the number of semiconductor wafers to be polished is increased, the cost required for the polishing pad to polish one semiconductor wafer is reduced, and the operation rate of the CMP apparatus is improved.

Further, according to the present invention, the diamond particle surface of the dresser is inclined, and the pressure applied to the polishing surface of the dresser is varied linearly with a nonzero slope. Therefore, the polishing amount of the polishing pad can be controlled to a uniform value. As a result, the length of the replacement period of a polishing pad is increased, and the operation rate of the CMP apparatus is significantly improved.

Although the present invention has been described by way of exemplary embodiments, it should be understood that many changes and substitutions may be made by those skilled in the art without departing from the spirit and the scope of the present invention which is defined only by the appended claims.

What is claimed is:

1. A polishing apparatus comprising a polishing pad and a dresser ring having a polishing particle surface for adjusting polishing of the polishing pad, wherein a depth of an entirety of an outermost diameter of said polishing particle surface of said dresser ring is greater than a depth of an entirety of an innermost diameter of said polishing particle surface of said dresser ring, so that said polishing particle surface in contact with the polishing pad is inclined.

2. A polishing apparatus as claimed in claim 1, wherein said polishing particle surface is inclined so that said polishing particle surface polishes at a prescribed rate.

3. A polishing apparatus as claimed in claim 1, wherein said polishing particle surface is linearly inclined.

4. A polishing apparatus as claimed in claim 1, wherein the depths at the innermost and outermost diameters are determined so that a grind rate at the outermost diameter is five times as large as the grind rate at the innermost diameter.

5. A polishing apparatus as claimed in claim 1, wherein said polishing particle surface is inclined so that displacement amount of the polishing pad varies along a length of the dresser when a constant pressure is applied along the length of the dresser.

6. A polishing apparatus comprising a polishing pad and a dresser having a polishing particle surface for adjusting polishing of the polishing pad, wherein said polishing particle surface that is in contact with the polishing pad includes isolated sections in a radial direction from a center of said dresser at which polishing adjusting pressure is appliable at different rates in the radial direction of said dresser.

7. A polishing apparatus as claimed in claim 6, wherein said polishing adjusting pressure is appliable to the isolated sections at the different rates so that said polishing particle surface polishes at a prescribed rate.

8. A polishing apparatus as claimed in claim 6, wherein the dresser is a dresser ring.

9. A polishing apparatus as claimed in claim 6, wherein the isolated sections of said polishing particle surface are separated by gaps.

10. A polishing pad adjusting method which uses a polishing apparatus comprising a polishing pad and a dresser having a polishing particle surface including isolated sections for adjusting polishing of the polishing pad, comprising:

obtaining a relation between a press-down pressure applied onto said polishing particle surface of said dresser and a polishing amount of said polishing pad; and determining a press-down pressure for each isolated section of the polishing particle surface so that a polishing amount distribution of said polishing pad is uniform.

11. A polishing pad adjusting method as claimed in claim 10, wherein the press-down pressures are applied so that said polishing particle surface polishes at a prescribed rate.

12. A polishing pad adjusting method as claimed in claim 10, wherein said dresser is a dresser ring.

13. A polishing pad adjusting method as claimed in claim 10, wherein the isolated sections are separated by gaps.

14. A polishing pad adjusting method as claimed in claim 10, wherein the isolated sections of said polishing particle surface of said dresser are isolated in a radial direction of said dresser.

15. A polishing pad dressing method which uses a polishing apparatus comprising a polishing pad and a dresser having a polishing particle surface including isolated sections for adjusting polishing of the polishing pad, comprising:

obtaining a relation between a press-down pressure applied onto said polishing particle surface of said dresser and a polishing amount of said polishing pad;

determining a press-down pressure for each isolated section of the polishing particle surface so that a polishing amount distribution of said polishing pad is uniform; and dressing said polishing pad in a state in which the determined press-down pressures are applied onto said dresser.

16. A polishing pad dressing method as claimed in claim 15, wherein the determined press-down pressures are applied so that said polishing particle surface polishes at a prescribed rate.

17. A polishing pad dressing method as claimed in claim 15, wherein said press-down pressure is applied onto a plurality of points on said polishing particle surface.

18. A polishing pad dressing method as claimed in claim 15, wherein the dresser is a dresser ring.

19. A polishing pad dressing method as claimed in claim 15, wherein the isolated sections are separated by gaps.

20. A polishing pad dressing method as claimed in claim 15, wherein the isolated sections of said polishing particle surface of said dresser are isolated in a radial direction of said dresser.

* * * * *